US010355387B2

(12) United States Patent
Hori et al.

(10) Patent No.: US 10,355,387 B2
(45) Date of Patent: Jul. 16, 2019

(54) CONNECTOR WITH A TERMINAL LOCKING MEMBER WITH A PLATE SPRING MEMBER

(71) Applicant: Molex, LLC, Lisle, IL (US)

(72) Inventors: Ryota Hori, Yamato (JP); Takuji Hanyu, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/899,240

(22) Filed: Feb. 19, 2018

(65) Prior Publication Data

US 2018/0261946 A1 Sep. 13, 2018

(30) Foreign Application Priority Data

Mar. 7, 2017 (JP) ..... 2017-042982

(51) Int. Cl.
*H01R 13/436* (2006.01)
*H01R 13/426* (2006.01)
*H01R 13/424* (2006.01)

(52) U.S. Cl.
CPC ..... *H01R 13/4362* (2013.01); *H01R 13/424* (2013.01); *H01R 13/426* (2013.01)

(58) Field of Classification Search
CPC ..... H01R 13/4362; H01R 13/424; H01R 13/426; H01R 13/4365; H01R 13/4368
USPC ..... 439/595, 752
See application file for complete search history.

(56) References Cited

U.S. PATENT DOCUMENTS 4,897,041 A * 1/1990 Heiney ..... H01R 23/661 439/404
5,066,252 A * 11/1991 Kato ..... H01R 13/4362 439/595
5,299,958 A * 4/1994 Ohsumi ..... H01R 13/4362 439/752
6,010,374 A * 1/2000 Miwa ..... H01R 13/4362 439/752
6,200,172 B1 3/2001 Konoya et al.
9,472,884 B2 10/2016 Kutsuna et al.
2004/0038589 A1* 2/2004 Takahashi ..... H01R 13/4365 439/595

(Continued)

FOREIGN PATENT DOCUMENTS

JP H05-144499 A 6/1993
JP H09-180804 A 7/1997

(Continued)

*Primary Examiner* — Travis S Chambers
(74) *Attorney, Agent, or Firm* — Molex, LLC

(57) ABSTRACT

A housing includes a hole that can receive a terminal therein, and a locking member reception recessed portion that can receive a locking member therein, the locking member includes a first protrusion that is received in the recessed portion and engages with a first portion of the housing when in a temporary locking position making insertion/removal of the terminal to the hole possible, and a second protrusion that is received in the recessed portion and engages with a second portion of the housing when in a main locking position making insertion/removal of the terminal to the hole impossible, and the second protrusion is formed on a wide portion of a plate spring member held from both sides having both ends fixed and the middle free, the plate spring member having one end side as a narrow portion, and the other end side being the wide portion.

4 Claims, 9 Drawing Sheets

(56) References Cited

U.S. PATENT DOCUMENTS

| | | | | |
|---|---|---|---|---|
| 2008/0020639 | A1 | 1/2008 | Ichio | |
| 2015/0340793 | A1* | 11/2015 | Kutsuna ..... | H01R 13/4362<br>439/733.1 |
| 2017/0207578 | A1* | 7/2017 | Abraham ..... | H01R 13/4361 |

FOREIGN PATENT DOCUMENTS

| | | | |
|---|---|---|---|
| JP | 2010-050018 | A | 3/2010 |
| JP | 2014-107233 | A | 6/2014 |
| WO | WO 2013-073228 | A1 | 5/2013 |

* cited by examiner

CONNECTOR WITH A TERMINAL LOCKING MEMBER WITH A PLATE SPRING MEMBER

RELATED APPLICATIONS

This application claims priority to Japanese Application No. 2017-042982, filed Mar. 7, 2017, which is incorporated herein by reference in its entirety.

TECHNICAL FIELD

The present disclosure relates to a connector.

BACKGROUND ART

Conventionally, to surely maintain a terminal connected to a terminal of an electric wire such as a cable, a retainer, that is, a connector provided with a terminal locking member is proposed (for example, see patent literature 1).

FIG. 9 is a partial expanded view illustrating the lock mechanism of a conventional terminal locking member.

In the drawings, 811 is a housing of a connector, and has a terminal reception hole 816 receiving a terminal 851 connected to the terminal of an electric wire 891. The terminal reception hole 816 penetrates the housing 811 in the front-back direction, and an opponent terminal that protrudes from an opponent connector not illustrated in the drawings is inserted from the side opposite the side in which the terminal 851 is inserted, and contacts the terminal 851. In the example illustrated in the drawing, the terminal reception hole 816 is disposed to be in two vertical rows. A cover housing 831, which covers the upper surface and the side surface is attached on the outer side of the housing 811.

Furthermore, 821 is a terminal locking member, and has an insertion hole 823 to which the terminal 851 is inserted, and a locking piece 825 that locks the terminal 851 by engaging with an engaging portion 855 of the terminal 851. Note that because the insertion hole 823 is formed only on a position corresponding to the terminal reception hole 816 on the lower row side, the locking piece 825 that locks the terminal 851 received in the terminal reception hole 816 on the lower row side is formed in the insertion hole 823, but the locking piece 825 that locks the terminal 851 received in the terminal reception hole 816 on the upper row side is formed on an upper surface 821*a* of the terminal locking member 821.

The housing 811 is open on the lower surface, and is provided with a locking member receiving groove 817 formed to intersect all terminal reception holes 816 extending in the width direction. The terminal locking member 821 is inserted in the locking member receiving groove 817 from below the housing 811. At this time, a back-locking protrusion 828*a* formed on the back surface of the arm member 828 formed near both ends in the width direction of the terminal locking member 821 engages with a locking portion 818 formed on both of the left and right sides of the housing 811. Furthermore, a side locking protrusion 827 protruding from both of the left and right sides of the terminal locking member 821 engages with a locking window 837 formed on both the left and right sides of the cover housing 831 attached to the housing 811. By this, the terminal locking member 821 is surely locked to the housing 811 and the cover housing 831, and each terminal 851 can be surely prevented from breaking away from the terminal reception hole 816.

Patent Literature 1: Japanese Unexamined Patent Application Publication No. 2014-107233

SUMMARY

However, in the conventional connector, because the lower end of the arm member 828 having the back-locking protrusion 828*a* formed thereon is in a free state without being fixed, for example, when displacing the terminal locking member 821 in the vertical direction to remove the cover housing 831 or the terminal 851, the free lower end may abut or catch other members or the like, and the arm member 828 may be damaged.

Furthermore, when the lower end thereof is connected to the main body of the terminal locking member 821 to prevent damage to the arm member 828, the engaging or engaging removal of the back-locking protrusion 828*a* and the locking portion 818 of the housing 811 is not carried out smoothly because the flexibility of the arm member 828 is lost.

Here, in light of the above problems of the conventional connector, an object of the present disclosure is to provide a highly reliable connector wherein a terminal locking member has high flexibility while being solid, is able to easily carry out the locking and locking removal with a housing, and wherein a locked state is surely maintained.

To obtain this, a connector is provided with a housing having a terminal mounted therein and a terminal locking member that prevents the terminal from separating from the housing, wherein the housing includes a terminal reception hole that can receive the terminal therein, and a locking member reception recessed portion that can receive the terminal locking member therein, the terminal locking member includes a first lock protrusion that is received in the locking member reception recessed portion and engages with a first lock portion of the housing when in a temporary locking position making insertion/removal of the terminal to the terminal reception hole possible, and a second lock protrusion that is received in the locking member reception recessed portion and engages with a second lock portion of the housing when in a main locking position making insertion/removal of the terminal to the terminal reception hole impossible, and the second lock protrusion is formed on a wide portion of a beam-shaped plate spring member held from both sides having both ends fixed and the middle free, the plate spring member having one end side as a narrow portion, and the other end side being the wide portion wider than the narrow portion.

In another connector, one end of the narrow portion side of the plate spring member is connected and fixed to a raised portion having the first lock protrusion formed thereon.

In yet another connector, the direction in which the first lock protrusion protrudes and the direction in which the second lock protrusion protrudes are orthogonal to each other.

In yet another connector, the housing further includes an operation opening connecting a back surface and a locking member reception recessed portion, and the second lock protrusion is positioned in the operation opening when the terminal locking member is in the main locking position.

In yet another connector, the terminal locking member can be displaced from the main locking position to the temporary locking position when the second lock protrusion is displaced and engagement with a second lock portion is removed.

According to the present disclosure, in a connector, a terminal locking member has high flexibility while being solid, and can easily carry out locking and locking removal with a housing, and a locked state with the housing can be surely maintained, and reliability can be improved.

DETAILED DESCRIPTION OF THE PREFERRED EMBODIMENTS

Embodiments will be described in detail below with reference to the drawings.

Figure 1:
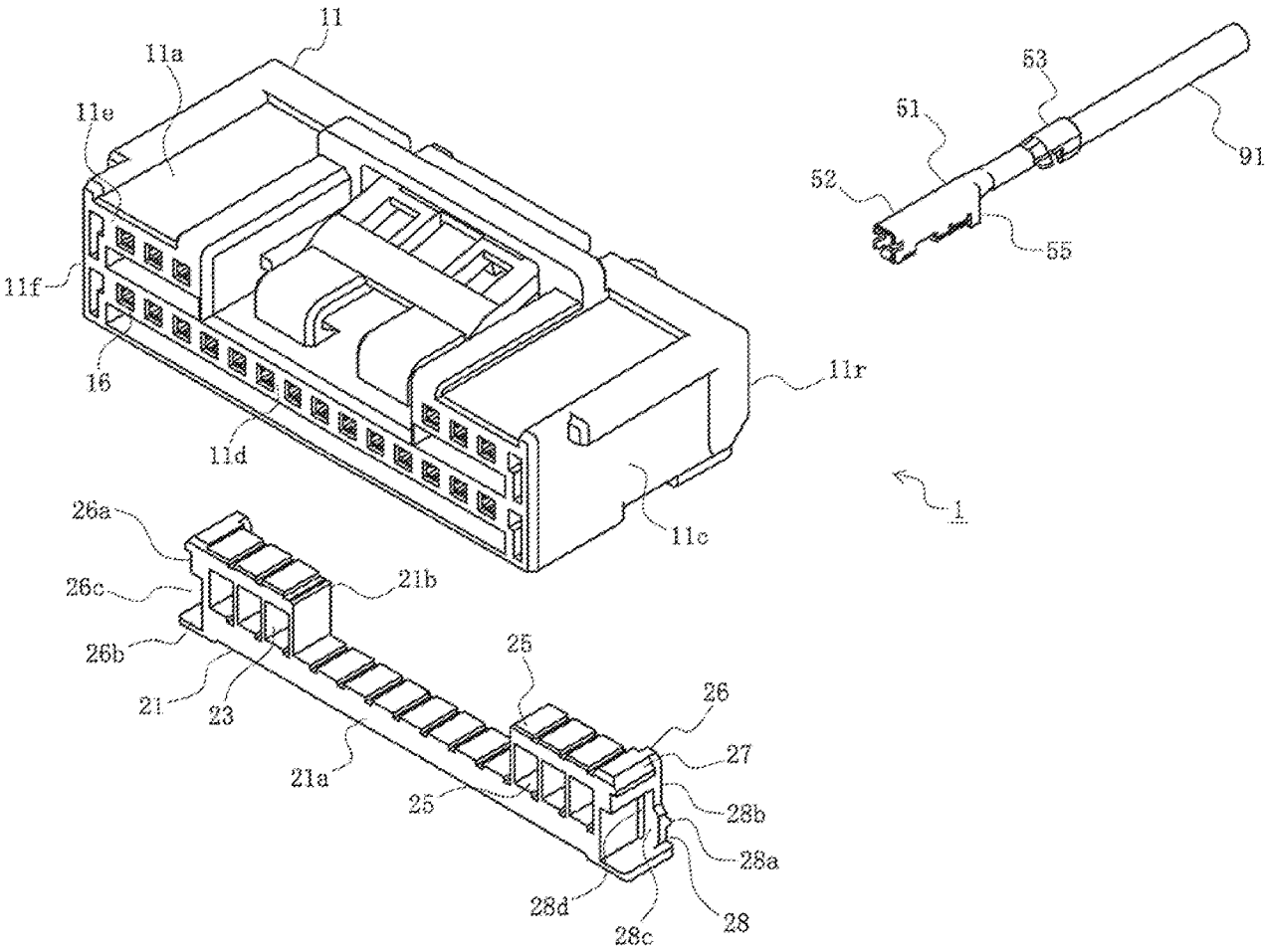
FIG. 1 is an exploded diagram viewing the connector of the present embodiment diagonally from above.
Figure 2:
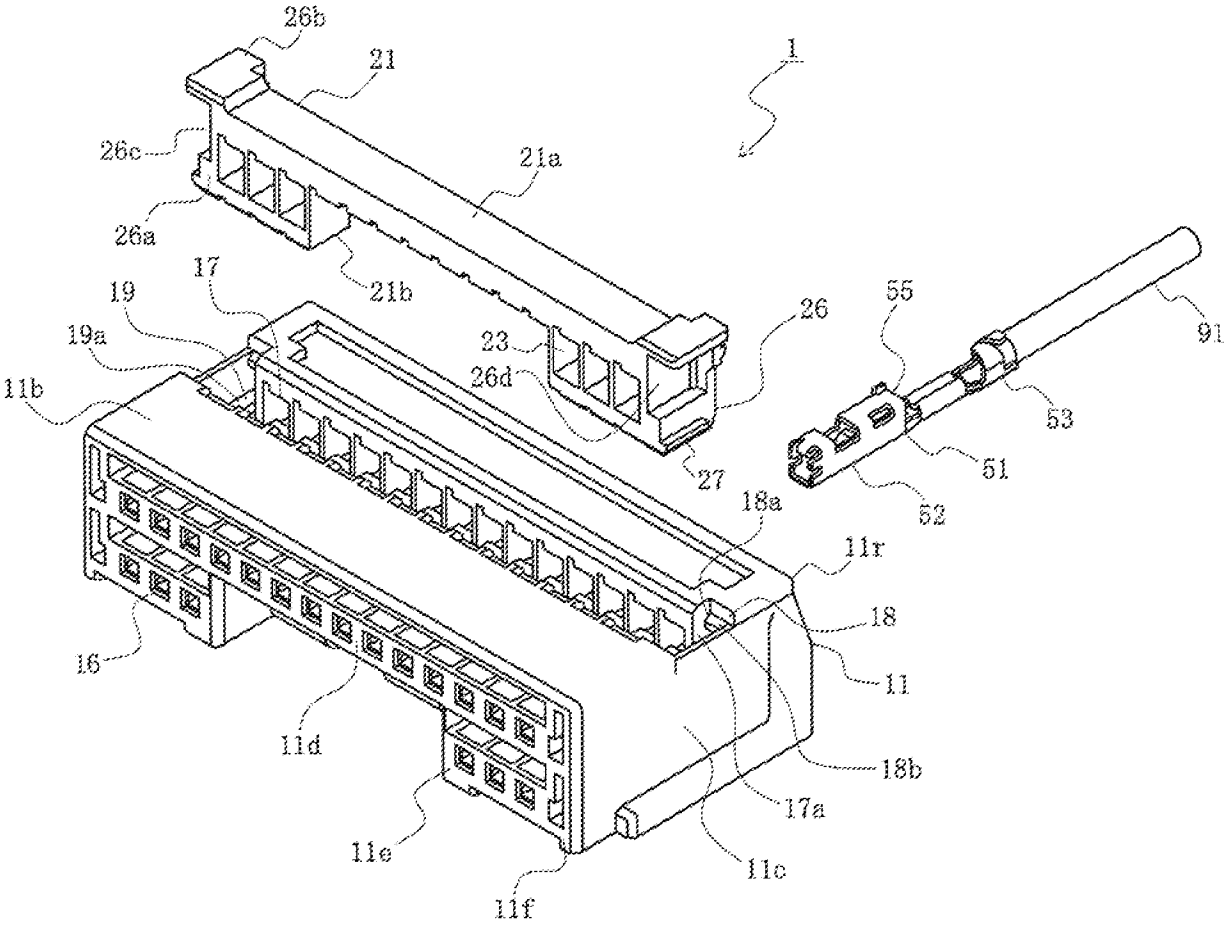
FIG. 2 is an exploded diagram viewing the connector of the present embodiment diagonally from below.
Figure 3:
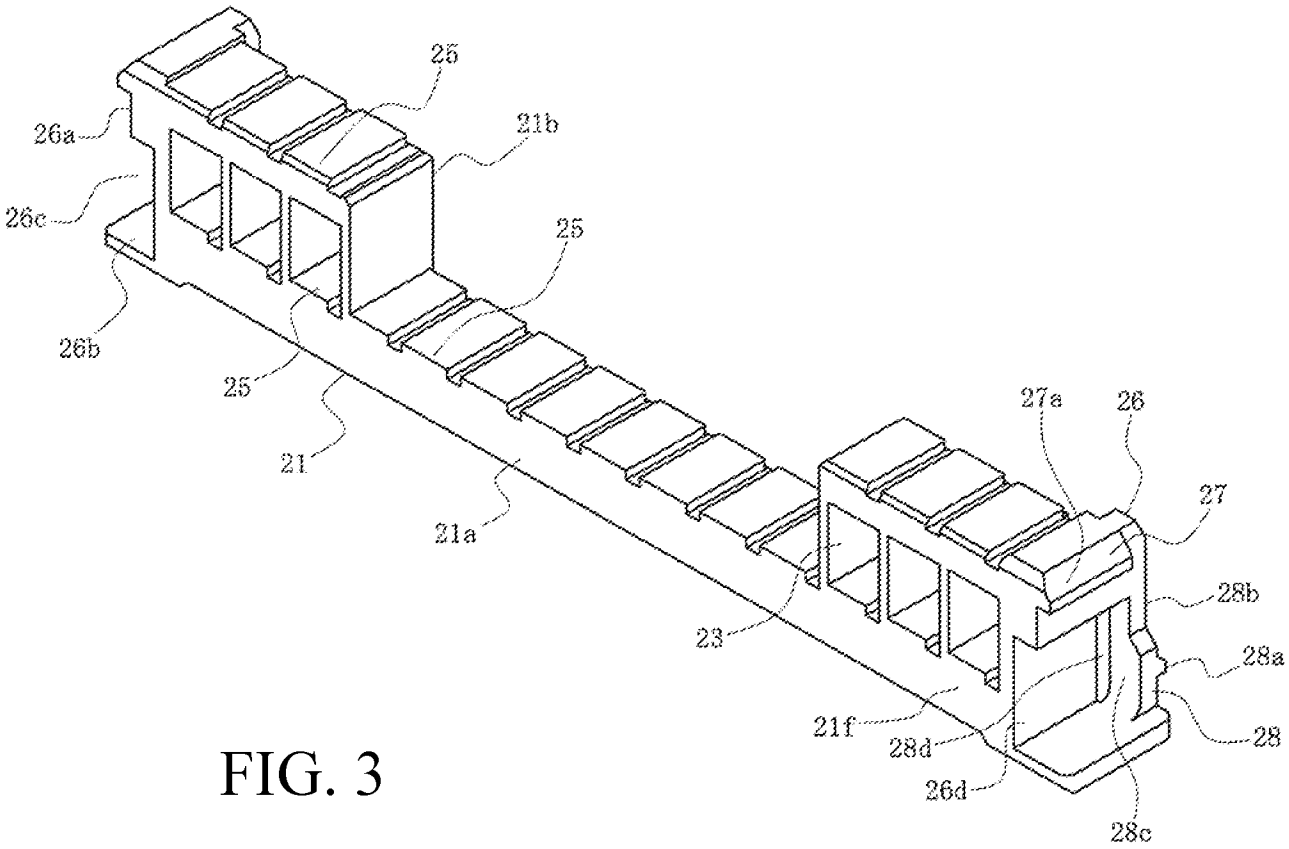
FIG. 3 is a perspective view viewing the terminal locking member of the present embodiment diagonally from the front.
Figure 4:
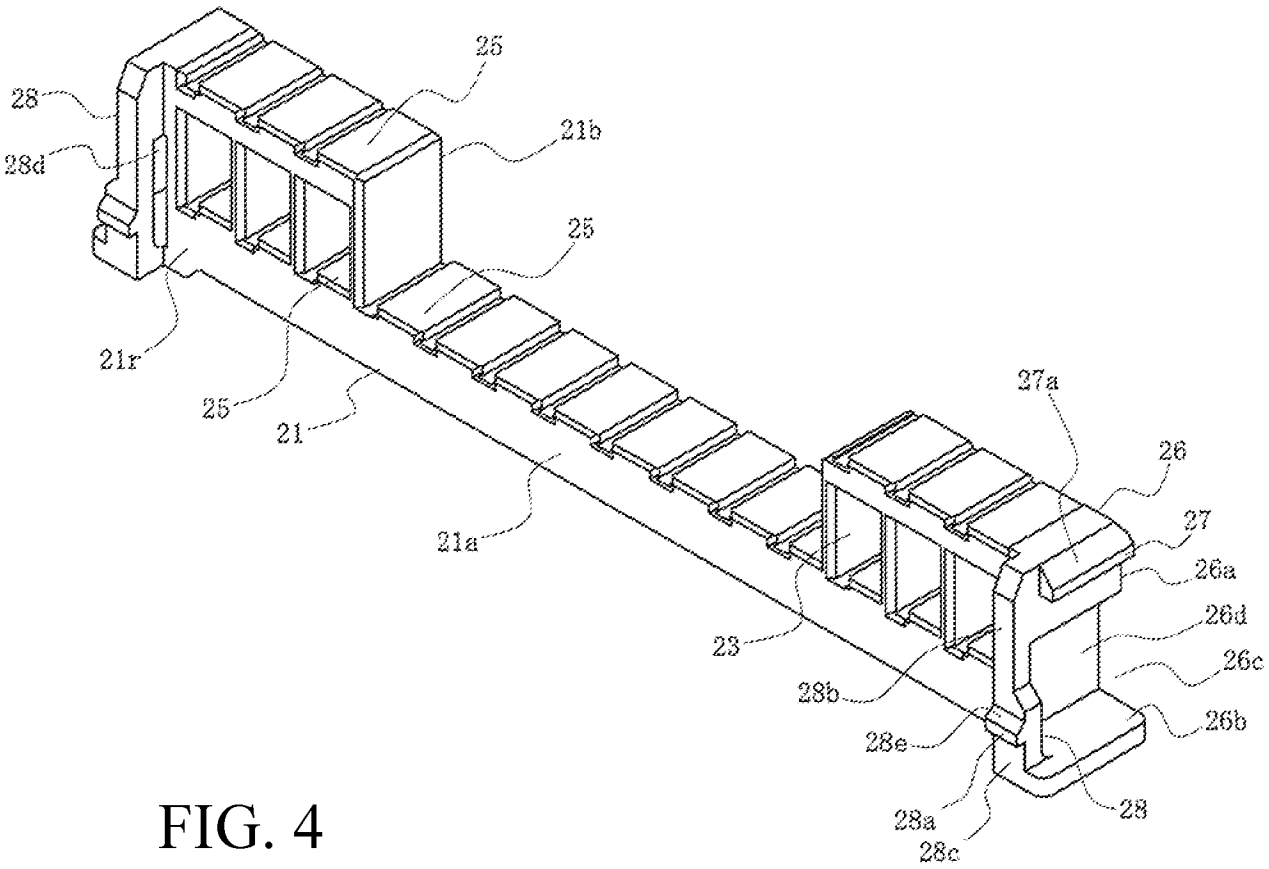
FIG. 4 is a perspective view viewing the terminal locking member of the present embodiment diagonally from the back.

FIG. 1 is an exploded diagram viewing the connector of the present embodiment diagonally from above, FIG. 2 is an exploded diagram viewing the connector of the present embodiment diagonally from below, FIG. 3 is a perspective view viewing the terminal locking member of the present embodiment diagonally from the front, and FIG. 4 is a perspective view viewing the terminal locking member of the present embodiment diagonally from the back.

In the drawings, 1 is the connector of the present embodiment, and is a connector connected to the terminal of a cable provided with a plurality of an electric wire 91. The connector 1 is connected, engaged with an opponent connector not illustrated in the drawings. The connector 1 and opponent connector are used in various apparatuses such as various electronic apparatuses, household apparatuses, medical apparatuses, industrial apparatuses, and transportation apparatuses, and may be used for any application. However, for simplicity in description, it will be used here in a transporting apparatus of an automobile or the like.

Note that in the present embodiment, expressions of up, down, left, right, front, back, and the like used to describe the configuration and operation of each part included in the connector 1 and other parts are relative and not absolute, and are appropriate when each part included in the connector 1 and the other parts are in the state illustrated in the drawings. However, when the state each part included in the connector and other parts have changed, these may be interpreted as changed based on the change of state.

The connector 1 is formed integrally by resin such as a synthetic resin, which is an insulating material, and is provided with a housing 1 provided with an entire shape such as a substantially rectangular parallelepiped shape, a terminal 51 made up of conductive metal, mounted to the housing 11 connected to the terminal of the electrical wire 91, and a terminal locking member 21, which is integrally formed by resin such as a synthetic resin, which is an insulating material, and prevents the terminal 51 from detaching from the housing 11. Note that FIGS. 1 and 2 only illustrate one terminal 51 for simplicity in description, but the number of the terminal 51 can be changed in any manner based on the number of the electric wire 91. Furthermore, the pitch of the terminal 51 can also be determined in any manner.

The housing 11 is a member that engages with an opponent housing of the opponent connector not illustrated in the drawings. The housing 11 is provided with a terminal reception hole 16 that extends in the front-back direction in the housing 11. The terminal reception hole 16 is a through-hole that penetrates the housing 11 in the front-back direction, and both ends thereof open to a front surface 11*f* as an engaging surface and a back surface 11*r* as a counter-engaging surface. The terminal reception hole 16 is arranged to form a row aligned in the width direction of the housing 11, and adjacent terminal reception holes 16 are divided by a division wall formed there between. Note that in the example illustrated in the drawings, the terminal reception hole 16 is disposed to make two rows, an upper and a lower, on a thick portion 11*e* around the vicinity of both ends in the width direction of the housing 11, and disposed to make one row on a thin portion 11*d* around the vicinity of the center in the width direction of the housing 11. Note that the number of terminal reception holes 16 can be changed in any manner based on the number of the terminal 51 and the electric wire 91. Furthermore, the pitch of the terminal reception hole 16 can also be determined in any manner based on the pitch of the terminal 51 and the electric wire 91.

The housing 11 is provided with a pair of side wall portions 11*c* that extend in the front-back direction of the connector 1, that is, the engaging direction with the opponent housing, a flat plate-shaped top wall portion 11*a* positioned above, and a bottom wall portion 11*b* positioned below, parallel to the top wall portion 11*a*. The side wall portions 11*c* and the bottom wall portion 11*b* are substantially flat plate members, but the top wall portion 11*a* has a portion corresponding to the thin portion 11*d* that is recessed. Furthermore, a locking member receiving groove 17 is open on the bottom wall portion 11*b* as a locking member reception recessed portion. The locking member receiving groove 17 is a long, narrow, groove-shaped recessed portion that extends in the width direction of the housing 11, formed to intersect the middle of all of the terminal reception holes 16, and receives the terminal locking member 21.

Both sides in the longitudinal direction (width direction of the housing 11) in the locking member receiving groove 17 form a fixing lock recessed portion 17*a*. The fixing lock recessed portion 17*a* is a portion that receives a fixing lock portion 26 of the terminal locking member 21, and the dimensions in relation to the front-back direction of the housing 11 are larger than other parts. A first lock portion 19 that engages with a first lock protrusion 27 provided by the terminal locking member 21, and a second lock portion 18*a* that engages with a second lock protrusion 28*a* provided by the terminal locking member 21, are arranged in the fixing lock recessed portion 17*a*. The first lock portion 19 is a protruding portion that protrudes from the inner surface of the side wall portions 11*c* toward the center in the width direction of the housing 11, and is a long, narrow protrusion that extends in the front-back direction of the housing 11. Note that an inclined surface 19*a* which entices the first lock protrusion 27 is formed on the bottom wall portion 11*b* of the first lock portion 19. Moreover, the second lock portion 18*a* is a protruding portion that protrudes from the thick rear part 18 of the bottom wall portion 11*b* toward the bottom surface 11*f* direction. Note that an inclined surface 18*b* which entices the second lock protrusion 28*a* is formed on the bottom wall portion 11*b* of the second lock portion 18*a*.

The terminal 51 is formed integrally by performing bending processing or punching processing on the conductive metal plate, and is provided with a contact tube portion 52 as a main body part, and an electric wire connection part 53 connected to the back end of the contact tube part 52. The electric wire connection part 53 is fixed to the electric wire 91, is the portion electrically connected to the core wire as a conductive wire provided by the electric wire 91, and caulks and fixes the electric wire 91 and the core wire. Note that the core wire and the electric wire connection part 53 can be more firmly connected and fixed by applying soldering as necessary. Furthermore, the contact tube part 52 is a portion contacting the opponent terminal provided by the opponent connector not illustrated in the drawings. The contact tube part 52 is a square tube-shaped portion extending from the tip end of the electric wire connection part 53 toward the front. Furthermore, the back end of the contact tube part 52 functions as a back-locking part 55, and when the terminal locking member 21 is received in the locking member receiving groove 17 of the housing 11, locking raised portions 25 provided by the terminal locking member 21 engage with the back locking part 55. By this, the terminal 51 received in the terminal reception hole 16 is prevented from breaking away toward the back.

The terminal locking member 21 is a member received in the locking member receiving groove 17 of the housing 11 in a state in which a front surface 21*f* and back surface 21*r* thereof are each oriented to the front surface 11*f* side and back surface 11*r* side, and is provided with a thin portion 21*a* having a long narrow shape extending in the width direction of the housing 11, a thick portion 21*b* connected to both ends of the thin portion 21*a*, and a fixing lock portion 26 formed on both ends of the thick portion 21*b*. The thin portion 21*a* and the thick portion 21*b* each correspond to the thin portion 11*d* and the thick portion 11*e* of the housing 11, and lock the terminal 51 received in the terminal reception hole 16 formed on the thin portion 11*d* and the thick portion 11*e* of the housing 11. A terminal insertion opening 23 that corresponds to the terminal reception hole 16 belonging to the bottom row on the thick portion 11*e* of the housing 11 is formed on the thick portion 21*b*. The terminal insertion opening 23 pierces the thick portion 21*b* from the front surface 21*f* to the back surface 21*r*. When the terminal locking member 21 is received in the locking member receiving groove 17 of the housing 11 in the temporary locking position, the terminal insertion opening 23 makes it possible to insert and remove the terminal 51 of the terminal reception hole 16 belonging to the bottom row on the thick portion 11*e* of the housing 11. Furthermore, the locking raised portions 25, which correspond to each of the terminal reception holes 16, are formed on the upper surface of the thin portion 21*a* and the thick portion 21*b*, and the bottom surface in the terminal insertion opening 23. The locking raised portions 25 engage with the back-locking part 55 of the terminal 51 received in the terminal reception hole 16 when the terminal locking member 21 is received in the locking member receiving groove 17 of the housing 11 and reaches the main locking position.

Furthermore, the fixing lock portion 26 includes a recessed portion 26*c* recessed toward the center of the width direction (toward the direction of the thin portion 21*a*), and an upper raised portion 26*a* and a lower raised portion 26*b* as raised portions protruding more toward the outer side of the width direction (toward the direction opposite the thin portion 21*a*) than a recessed bottom wall 26*d* extending in the vertical direction, which is the bottom surface of the recessed portion 26*c*. The bottom raised portion 26*b* is a thin plate-shaped member which protrudes more than the upper raised portion 26*a*, and blocks the opening in the bottom wall portion 11*b* of the fixing lock recessed portion 17*a* when the terminal locking member 21 is received in the locking member receiving groove 17 of the housing 11. Furthermore, a first lock protrusion 27 is formed on the outer side surface of the width direction of the upper raised portion 26*a*, and protrudes toward the outer side of the width direction. An inclined surface 27*a* which entices the first lock portion 19 is formed on the upper side of the first lock protrusion 27.

The end portion of the back surface 21*r* on the upper raised portion 26*a* and the lower raised portion 26*b* is connected by a long, narrow arm portion 28 that extends in the vertical direction. The arm portion 28 is fixed having both the upper and lower ends thereof connected to the upper raised portion 26*a* and the lower raised portion 26*b*, and is a beam-shaped plate spring member held from both sides capable of elastic deformation, with the middle thereof in a non-restricted free state, and a long, narrow gap 28*d* extending in the vertical direction is formed between the arm portion 28 and the recessed bottom wall 26*d*, which is the bottom surface of the recessed portion 26*c*. The second lock protrusion 28*a* protruding toward the back is formed on the surface on the back surface 21*r* side on the arm portion 28. An inclined surface 28*e* which entices the second lock portion 18*a* is formed on the upper side of the second lock protrusion 28*a*.

Furthermore, the arm portion 28 is provided with a fixed width when viewed from the outer side of the width direction, but when viewing from the front surface 21*f* side and the back surface 21*r* side, the upper side portion is a narrow portion 28*b* having a relatively narrow width, and the lower side portion is a wide portion 28*c* wider than the narrow portion 28*b*. The second lock protrusion 28*a* and the inclined surface 28*e* are formed near the upper end of the wide portion 28*c*. In this manner, because the second lock protrusion 28*a* is formed on the wide portion 28*c*, the width of the second lock protrusion 28*a* can be made larger, and as a result, the second lock protrusion 28*a* has improved strength and is more difficult to break. Along with this, the area that engages with the second lock portion 18*a* of the housing 11 becomes larger, thereby making it possible to surely maintain the engaged state with the second lock portion 18*a*. Furthermore, because the arm portion 28 includes the narrow portion 28*b*, flexibility is improved and the spring properties are raised. Additionally, because the arm portion 28 has both ends connected to the upper raised portion 26*a* and the lower raised portion 26*b*, the strength is improved making it more difficult to break, and damage does not occur by abutting or catching on other members and the like.

Next, the operation for attaching the terminal locking member 21 to the housing 11 will be described.

Figure 5:
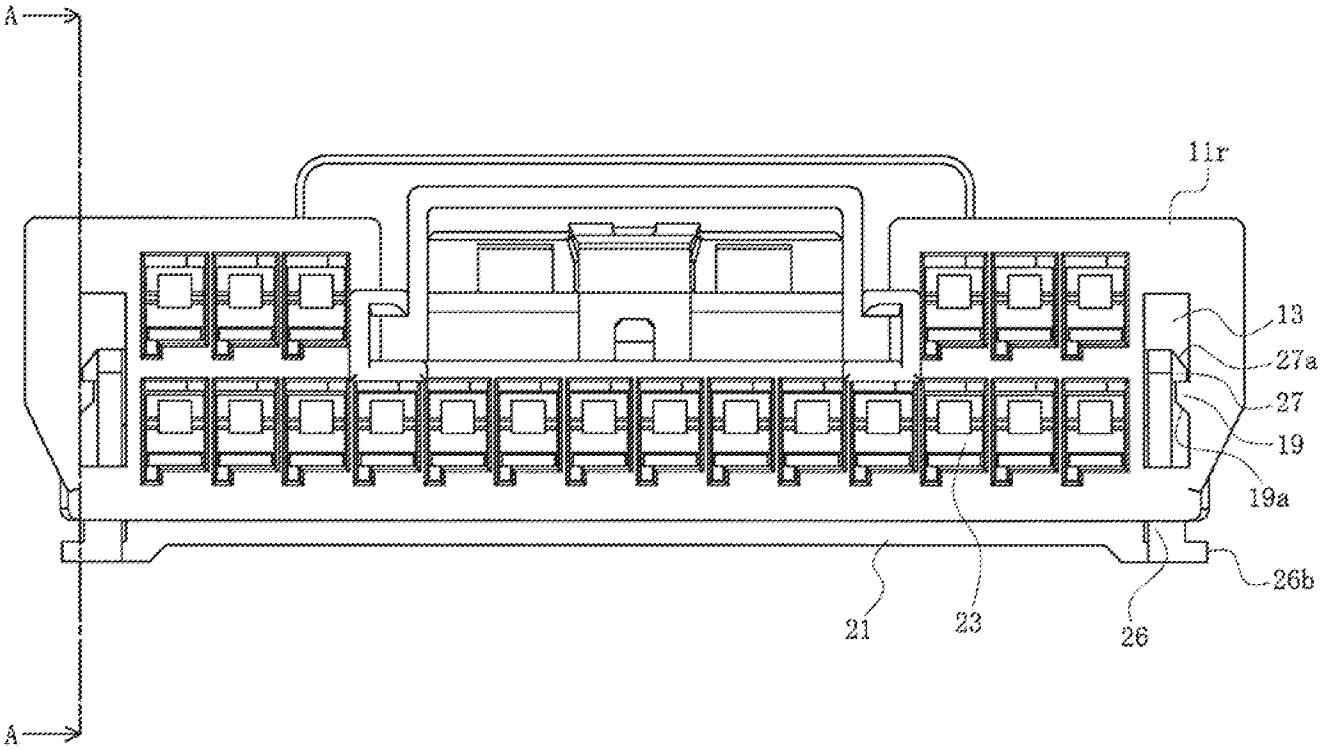
FIG. 5 is a back-side view of the connector when the terminal locking member of the present embodiment is in a temporary locking position.
Figure 6:
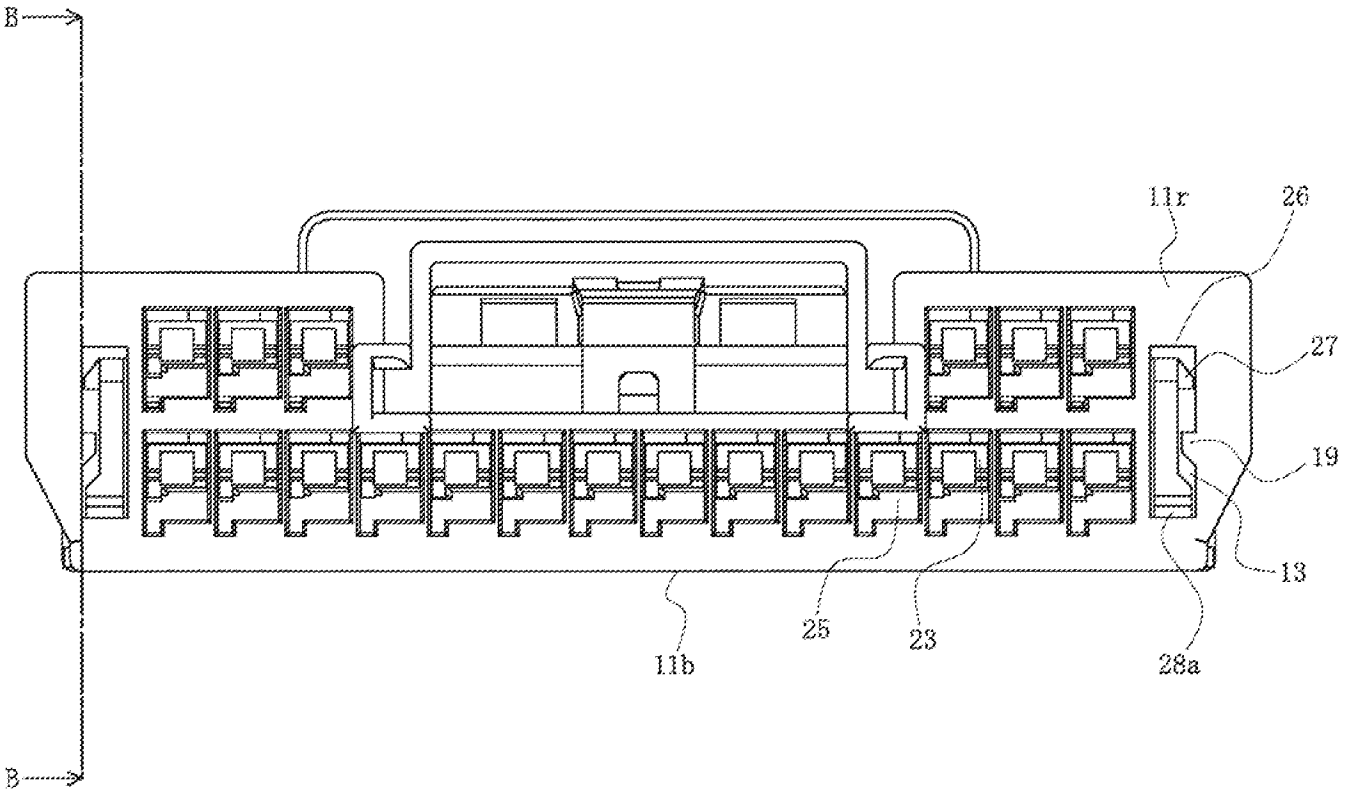
FIG. 6 is a back-side view of the connector when the terminal locking member of the present embodiment is in a main locking position.
Figure 7:
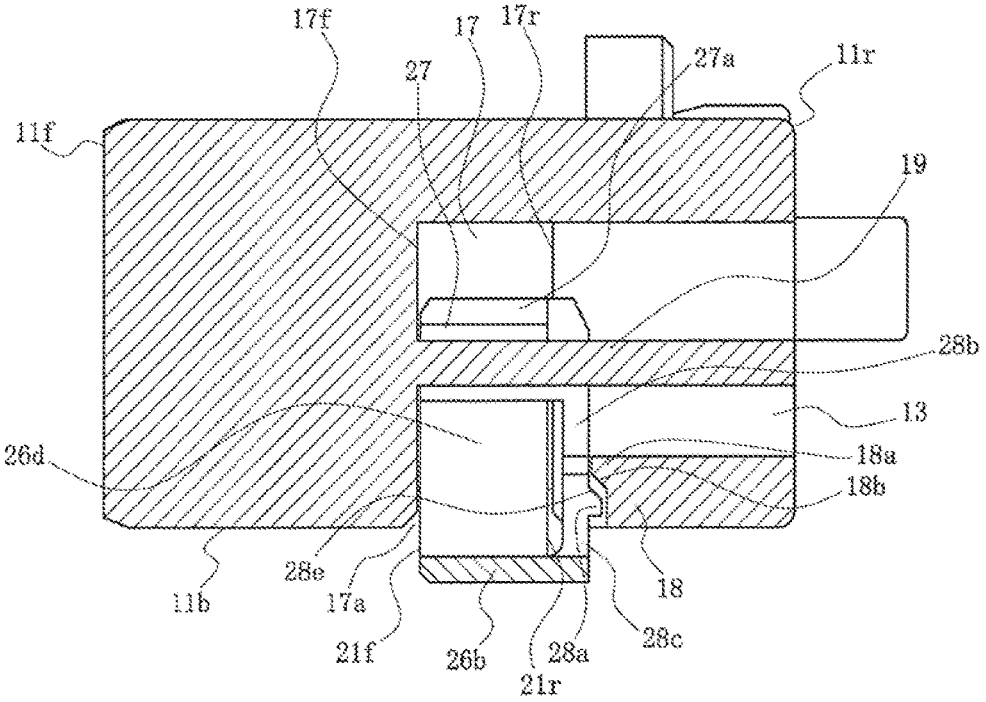
FIG. 7 is a cross-sectional view of the connector when the terminal locking member of the present embodiment is in a temporary locking position, and is a cross-section of arrow A-A in FIG. 5.
Figure 8:
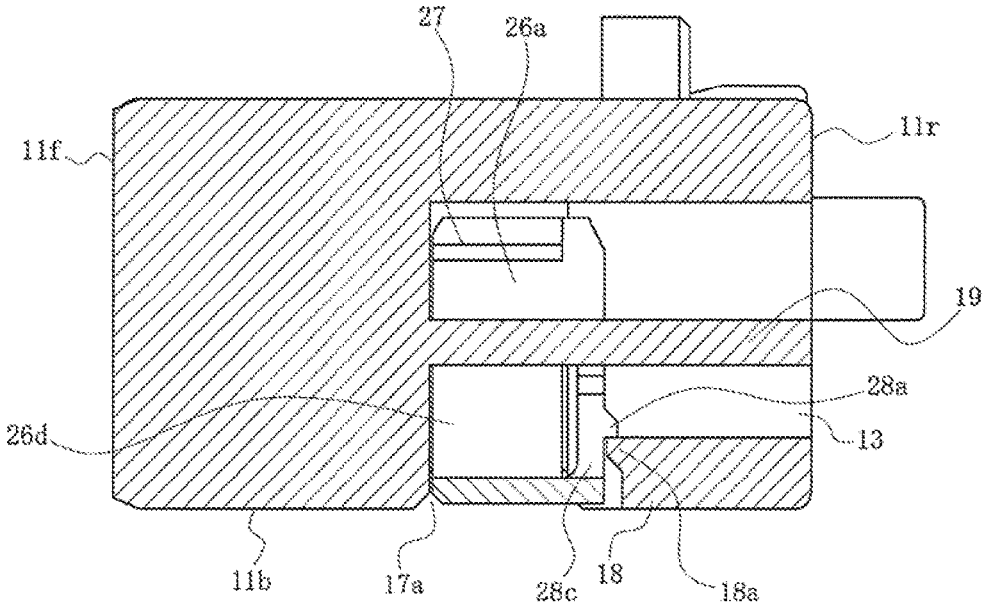
FIG. 8 is a cross-sectional view of the connector when the terminal locking member of the present embodiment is in a main locking position, and is a cross-section of arrow B-B in FIG. 6.
Figure 9:
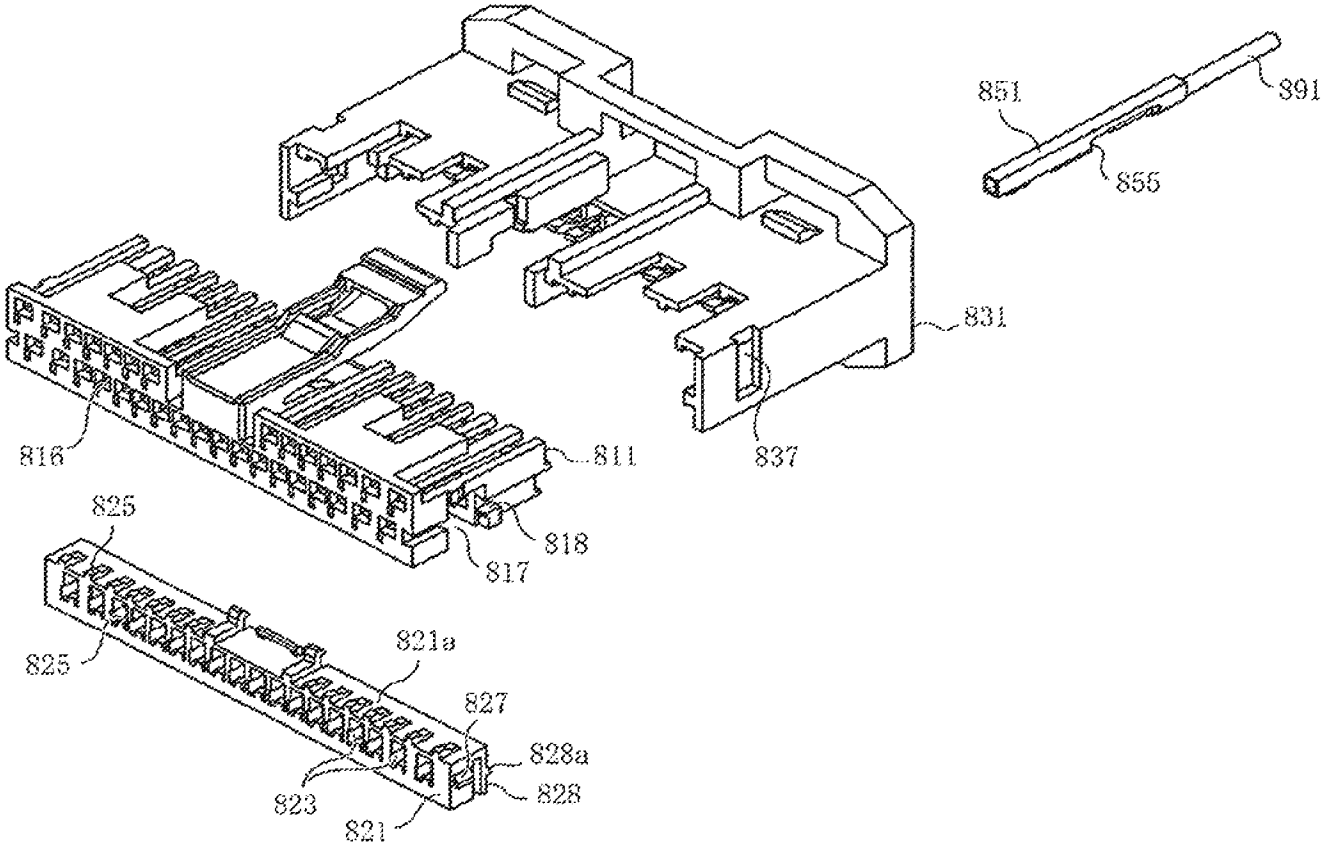
Prior art FIG. 9
FIG. 9 is a partial expanded view illustrating the lock mechanism of a conventional terminal locking member.

FIG. 5 is a back-side view of the connector when the terminal locking member of the present embodiment is in a temporary locking position, FIG. 6 is a back-side view of the connector when the terminal locking member of the present embodiment is in a main locking position, FIG. 7 is a cross-sectional view of the connector when the terminal locking member of the present embodiment is in a temporary locking position, and is a cross-section of arrow A-A in FIG. 5, and FIG. 8 is a cross-sectional view of the connector when the terminal locking member of the present embodiment is in a main locking position, and is a cross-section of arrow B-B in FIG. 6.

When attaching the terminal locking member 21 to the housing 11, an operator first operates the terminal locking member 21 and the housing 11 using fingers or the like, and faces the terminal locking member 21 to the locking member receiving groove 17 which opens to the bottom wall portion 11*b* of the housing 11 as illustrated in FIGS. 1 and 2. At this time, the position of the terminal locking member 21 with respect to the housing 11 is controlled so that the front surface 21*f* and the back surface 21*r* of the terminal locking member 21 each face the front surface 11*f* side and the back surface 11*r* side of the housing 11, and so that the upper surface of the thin portion 21*a* and the thick portion 21*b* having the locking raised portions 25 formed thereon face the bottom wall portion 11*b* of the housing 11.

The operator then raises the terminal locking member 21 relative to the housing 11, and inserts the terminal locking member 21 into the locking member receiving groove 17. At this time, the position of the terminal locking member 21 with respect to the housing 11 is controlled so that the fixing lock portion 26 positioned on both ends of the terminal locking member 21 is inserted into the fixing lock recessed portion 17*a* positioned on both ends of the locking member receiving groove 17.

Then, when the operator raises the terminal locking member 21 further relative to the housing 11, the first lock protrusion 27 of the left and right fixing lock portions 26 abut the first lock portion 19 in the left and right fixing lock recessed portions 17*a*. From this state, when the operator raises the terminal locking member 21 further relative to the housing 11, the first lock protrusion 27 of the left and right fixing lock portions 26 passes through the first lock portion 19 in the left and right fixing lock recessed portions 17*a*, and reach the portion above the first lock portion 19. At this time, the first lock protrusion 27 can smoothly pass through the first lock portion 19 because the inclined surface 27*a* which entices the first lock portion 19 is formed on the upper side of the first lock protrusion 27 and the inclined surface 19*a* which entices the first lock protrusion 27 is formed on the lower side of the first lock portion 19.

By this, the terminal locking member 21 is positioned in the temporary locking position as illustrated in FIGS. 5 and 7. In this temporary locking position, the first lock protrusion 27 and the first lock portion 19 are engaged together, and the terminal locking member 21 does not break away from the locking member receiving groove 17 because it is in a state in which most of the terminal locking member 21 is received in the locking member receiving groove 17 and is temporarily locked in the housing 11. Note that the front surface 21*f* and the back surface 21*r* of the terminal locking member 21 are in a state facing the front surface 17*f* and the back surface 17*r* of the locking member receiving groove 17, as illustrated in FIG. 7. Furthermore, in the temporary locking position, the terminal 51 can be inserted into the terminal reception hole 16 because the locking raised portion 25 is not raised to a high position.

The operator then operates the terminal 51 connected to the terminal of the electric wire 91 using fingers or the like, advances the terminal 51 from behind with respect to the housing 11, and inserts it into the terminal reception hole 16. The back-locking part 55, which is the back end of the contact tube part 52 of the terminal 51 reaches a portion further forward than the front surface 17*f* of the locking member receiving groove 17, and insertion into the terminal reception hole 16 of the terminal 51 is completed when a terminal locking piece of the housing 11 not illustrated in the drawings further engages with the terminal 51. The terminal locking piece prevents the terminal 51 from falling out backward by an unintended external force or the like.

Then, when the operator raises the terminal locking member 21 further relative to the housing 11, the second lock protrusion 28*a* of the left and right fixing lock portions 26 abuts the second lock portion 18*a* in the left and right fixing lock recessed portions 17*a*, pass through the second lock portion 18*a*, and reach a portion above the second lock portion 18*a*. At this time, the second lock protrusion 28*a* can smoothly pass through the second lock portion 18*a* because the inclined surface 28*e* which entices the second lock portion 18*a* is formed on the upper side of the second lock protrusion 28*a* and the inclined surface 18*b* which entices the second lock protrusion 28*a* is formed on the lower side of the second lock portion 18*a*. Moreover, the second lock protrusion 28*a* can elastically deform toward the front surface 21*f* because it is formed on the arm portion 28 that functions as a plate spring member, and the second lock protrusion 28*a* can thereby more smoothly pass through the second lock portion 18*a*.

By this, the terminal locking member 21 is positioned in the main locking position as illustrated in FIGS. 6 and 8. In the main locking position, the second lock protrusion 28*a* and the second lock portion 18*a* are engaged together, and the terminal locking member 21 is in a state in which the entirety is received in the locking member receiving groove 17, the lower raised portion 26*b* of the left and right fixing lock portions 26 blocks the opening in the bottom wall portion 11*b* of the fixing lock recessed portion 17*a*, and it is locked to the housing 11. In the main locking position, because the locking raised portion 25 is raised to a high position and engaged with the back-locking part 55 of the terminal 51 in which insertion to the terminal reception hole 16 has completed, the terminal 51 is surely prevented from breaking away backward from the terminal reception hole 16 and being separated from the housing 11.

Furthermore, for example, as in a case when the terminal 51 is taken out from the terminal reception hole 16 for maintenance or the like, it is possible to displace the terminal locking member 21 from the main locking position to the temporary locking position if necessary. In this case, the operator can displace the second lock protrusion 28*a* toward the front surface 21*f* by inserting a long, narrow rod-shaped operation member not illustrated in the drawings from the back surface 11*r* side into an operation hole 13 that connects the back surface 11*r* and the fixing lock recessed portion 17*a* of the housing 11, abutting the front end of the operation member to the second lock protrusion 28*a* or the arm portion 28, and applying pressure. Then, because the engagement of the second lock protrusion 28*a* and the second lock portion 18*a* is removed, the operator can displace until the temporary locking position by relatively lowering the terminal locking member 21 with respect to the housing 11.

Note that even if the second lock protrusion 28*a* is largely displaced toward the front surface 21*f* by being pressed by the operation member, the first lock protrusion 27 does not displace because the second lock protrusion 28*a* and the upper raised portion 26*a* with the first lock protrusion 27 formed thereon are connected by the flexible arm portion 28. Particularly, because there is the highly flexible narrow portion 28*b* between the second lock protrusion 28*a* and the upper raised portion 26*a*, the displacement of the second lock protrusion 28*a* does not affect the first lock protrusion 27. Furthermore, even if the first lock protrusion 27 is displaced in the same direction due to the second lock protrusion 28*a* being displaced, because the protruding direction of the first lock protrusion 27 is the direction orthogonal to the protruding direction of the second lock protrusion 28*a*, the engagement of the first lock protrusion 27 and the first lock portion 19 is not removed.

Therefore, even if the operator operates the operation member with a larger force than necessary and largely displaces the second lock protrusion 28*a*, the engagement of the first lock protrusion 27 and the first lock portion 19 is not removed, and the terminal locking member 21 does not break away from the locking member receiving groove 17. Furthermore, because the arm portion 28 having the second lock protrusion 28*a* formed thereon is a beam-shaped member held from both sides having both ends supported, damage does not occur even if the operator operates the operation member with a larger force than necessary and largely displaces the second lock protrusion 28*a*.

In this manner, in the present embodiment, the connector 1 is provided with the housing 11 having the terminal 51 mounted thereon, and the terminal locking member 21 which prevents the terminal 51 from detaching from the housing 11. The housing 11 includes the terminal reception hole 16 that can receive the terminal 51 therein and the locking member receiving groove 17 that can receive the terminal locking member 21 therein, the terminal locking member 21 includes the first lock protrusion 27 that is received in the locking member receiving groove 17 and engages with the first lock portion 19 of the housing 11 when in the temporary locking position making the insertion/removal of the terminal 51 to the terminal reception hole 16 possible, and the second lock protrusion 28*a* that is received in the locking member receiving groove 17 and engages with the second lock portion 18*a* of the housing 11 when in the main locking position making the insertion/removal of the terminal 51 to the terminal reception hole 16 impossible, and the second lock protrusion 28*a* is formed on the wide portion 28*c* of the beam-shaped arm portion 28 held from both sides having both ends fixed and the middle free, the arm portion 28 having one end side as the narrow portion 28*b*, and the other end side being the wide portion 28*c* wider than the narrow portion 28.

By this, damage is prevented from occurring by the arm portion 28 abutting or catching on other members and the like, and the solidity of the arm portion 28 and the second lock protrusion 28*a* can be maintained because the second lock protrusion 28*a* is formed on the wide portion 28*c*. Furthermore, the flexibility of the arm portion 28 is high, and the second lock protrusion 28*a* can be flexibly displaced. That is, the terminal locking member 21 can have high flexibility while being solid, and can easily carry out the locking and locking removal with the housing 11, and the locked state with the housing 11 can be surely maintained. Therefore, reliability of the connector 1 is improved.

Furthermore, one end of the narrow portion 28*b* side of the arm portion 28 is connected and fixed to the upper raised portion 26*a* having the first lock protrusion 27 formed thereon. In this manner, because the extremely flexible narrow portion 28*b* exists between the wide portion 28*c* having the second lock protrusion 28*a* formed thereon, and the upper raised portion 26*a* having the first lock protrusion 27 formed thereon, even if the second lock protrusion 28*a* is displaced and the engagement with the second lock portion 18*a* is removed, the displacement of the second lock protrusion 28*a* does not transfer to the first lock protrusion 27, and the first lock protrusion 27 is not displaced. Therefore, the engagement of the first lock protrusion 27 and the first lock portion 19 is not removed, and the terminal locking member 21 does not break away from the locking member receiving groove 17.

Additionally, the direction in which the first lock protrusion 27 protrudes and the direction in which the second lock protrusion 28*a* protrudes are orthogonal to each other. Furthermore, even if the first lock protrusion 27 is displaced in the same direction due to the second lock protrusion 28*a* being displaced, because the protruding direction of the first lock protrusion 27 is orthogonal to the protruding direction of the second lock protrusion 28*a*, the engagement of the first lock protrusion 27 and the first lock portion 19 is not removed.

Additionally, the housing 11 includes the operation opening 13 connecting the back surface 11*r* and the locking member receiving groove 17, and the second lock protrusion 28*a* is positioned in the operation opening 13 when the terminal locking member 21 is in the main locking position. Additionally, the terminal locking member 21 can be displaced from the main locking position to the temporary locking position when the second lock protrusion 28*a* is displaced and engagement with the second lock portion 18*a* is removed. Therefore, as in a case when the terminal 51 is taken out from the terminal reception hole 16 for maintenance or the like, it is possible to operate the second lock protrusion 28*a* via the operation opening 13 and easily remove the engagement of the second lock protrusion 28*a* and the second lock portion 18*a* when it is necessary to displace the terminal locking member 21 from the main locking position to the temporary locking position.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to connectors.

The invention claimed is:

1. A connector, comprising:

a housing having a terminal mounted therein; and a terminal locking member that prevents the terminal from separating from the housing, wherein:

the housing includes a terminal reception hole that can receive the terminal therein, and a locking member reception recessed portion that can receive the terminal locking member therein, the terminal locking member includes a pair of fixing lock portions formed on opposite ends of the terminal locking member, each fixing lock portion having an upper raised portion, a lower raised portion, and a recessed portion, each upper raised portion having a first lock protrusion formed on an outer side surface thereof, each first lock protrusion is received in the locking member reception recessed portion and engages with a first lock portion of the housing when in a temporary locking position making insertion/removal of the terminal to the terminal reception hole possible, the terminal locking member further includes a pair of arm portions, each arm portion is fixed at an upper end thereof to a respective one of the upper raised portions and at a lower end thereof to a respective one of the lower raised portions, each arm portion being separated from a respective one of the recessed portions by a gap, each arm portion having a narrow portion proximate to the upper raised portion and a wider portion proximate to the lower raised portion, each wider portion having a second lock protrusion formed on a rear surface thereof, each second lock protrusion is received in the locking member reception recessed portion and engages with a second lock portion of the housing when in a main locking position making insertion/removal of the terminal to the terminal reception hole impossible.

2. The connector according to claim 1, wherein a direction in which the first lock protrusion protrudes and a direction in which the second lock protrusion protrudes are orthogonal to each other.

3. The connector according to claim 1, wherein the housing includes an operation opening connecting a back surface and the locking member reception recessed portion, and wherein the second lock protrusion is positioned in the operation opening when the terminal locking member is in the main locking position.

4. The connector according to claim 1, wherein the terminal locking member can be displaced from the main locking position to the temporary locking position when the second lock protrusion is displaced and engagement with the second lock portion is removed.

* * * * *